US009180987B2

(12) United States Patent
Grimm et al.

(10) Patent No.: US 9,180,987 B2
(45) Date of Patent: Nov. 10, 2015

(54) THERMOFORM PACKAGING MACHINE AND METHOD FOR STRETCHING A FILM WEB

(75) Inventors: Bernhard Grimm, Kempten (DE); Annett Grott, Wolfertschwenden (DE)

(73) Assignee: MULTIVAC SEPP HAGGENMUELLER GMBH & CO. KG, Wolfertschwenden (DE)

( * ) Notice: Subject to any disclaimer, the term of this patent is extended or adjusted under 35 U.S.C. 154(b) by 826 days.

(21) Appl. No.: 13/277,586

(22) Filed: Oct. 20, 2011

(65) Prior Publication Data

US 2012/0096809 A1 Apr. 26, 2012

(30) Foreign Application Priority Data

Oct. 20, 2010 (DE) ..... 10 2010 048 977

(51) Int. Cl.

| | |
|---|---|
| ***B65B 9/04*** | (2006.01) |
| ***B65B 47/02*** | (2006.01) |
| ***B65B 41/18*** | (2006.01) |
| ***B65B 7/16*** | (2006.01) |

(52) U.S. Cl.
CPC .. *B65B 9/04* (2013.01); *B65B 41/18* (2013.01)

(58) Field of Classification Search
CPC ..... B65B 9/04; B65B 47/02; B65B 41/18
USPC ..... 53/453, 559, 51, 64, 141, 442, 557, 53/329.2–329.5, 477, 478
See application file for complete search history.

(56) References Cited

U.S. PATENT DOCUMENTS

| | | | | |
|---|---|---|---|---|
| 3,762,125 | A * | 10/1973 | Prena | 53/51 |
| 3,805,486 | A * | 4/1974 | Mahaffy et al. | 53/559 |
| 4,033,089 | A * | 7/1977 | Byland | 53/442 |
| 4,034,536 | A * | 7/1977 | Mahaffy et al. | 53/433 |
| 6,247,293 | B1 * | 6/2001 | Todd et al. | 53/562 |
| 2007/0056252 | A1 * | 3/2007 | Wetter | 53/441 |

FOREIGN PATENT DOCUMENTS

| | | |
|---|---|---|
| DE | 2349475 A1 | 4/1974 |
| EP | 1620317 B1 | 11/2006 |

* cited by examiner

*Primary Examiner* — Andrew M Tecco
*Assistant Examiner* — Praachi M Pathak
(74) *Attorney, Agent, or Firm* — Husch Blackwell LLP

(57) ABSTRACT

The disclosure relates to a thermoform packaging machine for stretching a film web as well as to a method of operating a thermoform packaging machine, in the case of which a stretching station with a heating unit is provided, and the film web is actively cooled by means of a film cooling device after stretching of the film web.

18 Claims, 6 Drawing Sheets

THERMOFORM PACKAGING MACHINE AND METHOD FOR STRETCHING A FILM WEB

CROSS-REFERENCE TO RELATED APPLICATIONS

This application claims foreign priority benefits under 35 U.S.C. §119(a)-(d) to German patent application number DE 10 2010 048 977.8, filed Oct. 20, 2010, which is incorporated by reference in its entirety.

TECHNICAL FIELD

The disclosure relates to a thermoform packaging machine for stretching a film web according to a method.

BACKGROUND

EP 1 620 317 B1 discloses a thermoform packaging machine comprising a stretching device for stretching a cover film so as to position the printed cover film very exactly on top of a packaging trough. A photocell detects here, by means of a print mark on the cover film, the position of the print image relative to the forward feed and, consequently, the packaging trough. The print image is normally undersized and it is stretched in that a clamping bar clamps the flexible cover film a short time before the forward feed movement ends, the remainder of the forward feed movement then stretching the cover film. In addition, the clamping bar can be displaced in a direction opposite to the direction of feed so as to stretch the cover film until the desired dimension has been reached. In so doing, the tensioned cover film is sealed onto a trough which is implemented such that it is able to counteract the tension of the cover film so that an optically pleasing package can be obtained.

In addition, stretching units are known in which the cover film is heated by a heating plate in the area in which stretching takes place. Stretching of this area of the film is made possible by heat input. Especially films/foils of larger thicknesses, in particular hard films whose thickness exceeds 200 μm, necessitate a heat input so as to allow stretching of the film in the elastic-plastic range. During the subsequent forward feed movements of the cover film, an uncontrolled stretching behavior will occur up to a sealing station due to the non-uniform heat distribution in the cover film, the high accelerations when the forward feed movement is started and the deflections at the deflection pulleys. Especially when the cover film has to travel a comparatively long distance until it reaches the sealing station, this uncontrolled stretching behavior will lead to frequent readjustments and large tolerances as regards the positioning and the size of the print image relative to the packaging trough. The reason for this is also an uncontrolled shrinkage of the film web due to the areas of different temperatures existing in the cover film.

The stretched length of the heated film area results, after cooling down up to the sealing station, in an elongation of less than one percent of the print image. Therefore, the film supplier has to observe narrow tolerances with respect to the length and the position of the print image.

SUMMARY

It is an object of the present disclosure to provide a thermoform packaging machine and a method for stretching a film web, which allow the above-described drawbacks to be remedied.

A thermoform packaging machine according to the present disclosure comprises a stretching station for stretching a film web, the stretching station having a heating unit, a print mark sensor and a clamping unit, and further including a film cooling device. The film cooling device has the effect that the film web is cooled rapidly after having been stretched, and that the film web and, consequently, the print image will not undergo any uncontrolled changes during the subsequent forward feed movements up to a sealing station. The print image can then be positioned very precisely on top of the packaging trough and sealed onto the latter in an air-tight manner.

According to an advantageous embodiment, the film cooling device is provided with a cooling plate. The cooling plate is a simple but efficient solution for dissipating, at least from the heated area of the film web, the heat that has been input by the heating means during or after the stretching process.

Preferably, the film cooling device is located on the other side of the film web from the heating unit so as to provide a particularly compact structural design.

According to an embodiment of the present disclosure, the stretching station includes a lifting unit for moving the film cooling device towards and away from the film web. The film cooling device can thus be implemented as a permanently cooled unit and be brought into contact with the film web only for the purpose of cooling.

The film cooling device and the heating unit may be moved in common relative to the film web by means of a lifting unit. These movements are executed e.g. such that the heating unit moves away from the film web, whereas the film cooling device simultaneously moves towards the film web and vice versa. This allows a space-saving, low-cost solution, since only one actuator is provided for the movements of the film cooling device and of the heating unit.

According to an embodiment of the present disclosure, the film cooling device is arranged above the sealing station, a switch cabinet of the thermoform packaging machine provided in this area being, by way of example, used as a mounting surface.

In accordance with an embodiment of the present disclosure, the stretching station comprises at least one clamping bar which is pivotable so as to stretch the film web. Ideally, the clamping bar has a servo drive which is connected to the controller and which carries out very precise stretching of the film web. Alternatively, a linear movement of the clamping bar is imaginable as well.

A method according to the present disclosure used for stretching a film web on a thermoform packaging machine by means of a stretching station including a heating unit is so conceived that the stretching station actively cools the film web after heating and stretching of the film web. This leads to a print image which remains unchanged up to a sealing station, in spite of the accelerations of the subsequent forward feed movements, and which can be precisely positioned on and sealed to a package.

The film web may be cooled by a film cooling device, in particular a cooling plate, so as to rapidly dissipate the heat inputted in the film by the heating unit and maintain thus a high performance of the thermoform packaging machine.

The film web may be cooled until it has been thermofixed so as to maintain the film web in an unchanged condition for the additional forward feed movements. For example, the film web may be cooled sufficiently so that the film web will not further deform (e.g., stretch) during the additional forward feed movements.

The film web may be cooled through contact with the film cooling device so as to dissipate the heat efficiently and rapidly.

According to an embodiment of the present disclosure, a controller receives a signal of a print mark sensor and evaluates said signal together with parameters which are stored in said controller and which have been inputted by a user, and controls the stretching of the film web and the size and position of the print image according to the packaging trough. The print mark represents a reference for the position of the print image and serves to determine the degree of stretching of the print image.

The stretching may be executed by a clamping bar, which presses the film web against a deflection pulley and which then executes a radial movement about the deflection pulley with the clamped part of the film web by means of a servo drive. The servo drive is suitable for achieving the accuracy of the length to be stretched and also for applying the force that is required for this purpose.

In the following, an advantageous embodiment of the present disclosure will be described in more detail with reference to the below drawings.

DETAILED DESCRIPTION

Figure 1:
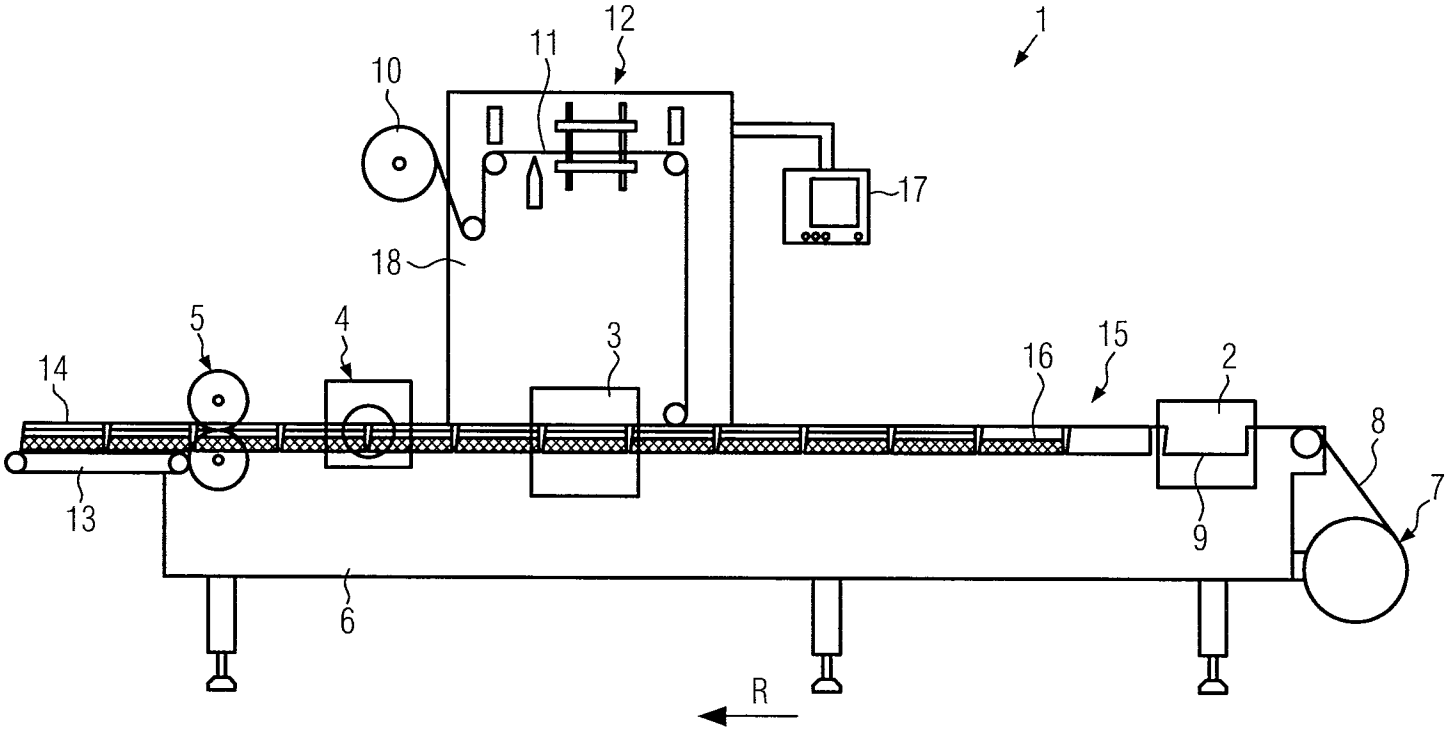
FIG. 1 shows a front view of a thermoform packaging machine according to the present disclosure.

Identical and similar components are provided with identical reference numerals throughout the figures.

As required, detailed embodiments are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIG. 1 shows a schematic view of a thermoform packaging machine 1. The latter comprises a forming station 2, a sealing station 3, a cross-cutting station 4 and a longitudinal cutting station 5 which are, in this sequence, arranged on a machine frame 6 in a working direction R. On the input side, a supply roll 7 is provided on the machine frame 6, from which a bottom film/foil 8 is unwound. In the forming station 2 a packaging trough 9 is formed. In the area of the sealing station 3, a material storage unit 10 is provided, from which a film or film web 11 is unwound. Before the film web 11 is supplied to the sealing station 3, it passes through a stretching station 12.

On the output side, a discharge device 13 in the form of a conveyor belt is provided on the packaging machine, with which finished, singulated packages 14 are transported away. Furthermore, the packaging machine 1 comprises a feeding device which is not shown, said feeding device engaging the bottom film 8 from the side and transporting it cyclically in the main work cycle in the working direction R. The feeding device can be realized e.g. by laterally arranged transport chains.

In the area of the infeed line 15, a product 16 is fed in. A controller 17 used for inputting parameters by the operator and for visualizing operating states is attached to a switch cabinet 18.

Figure 2:
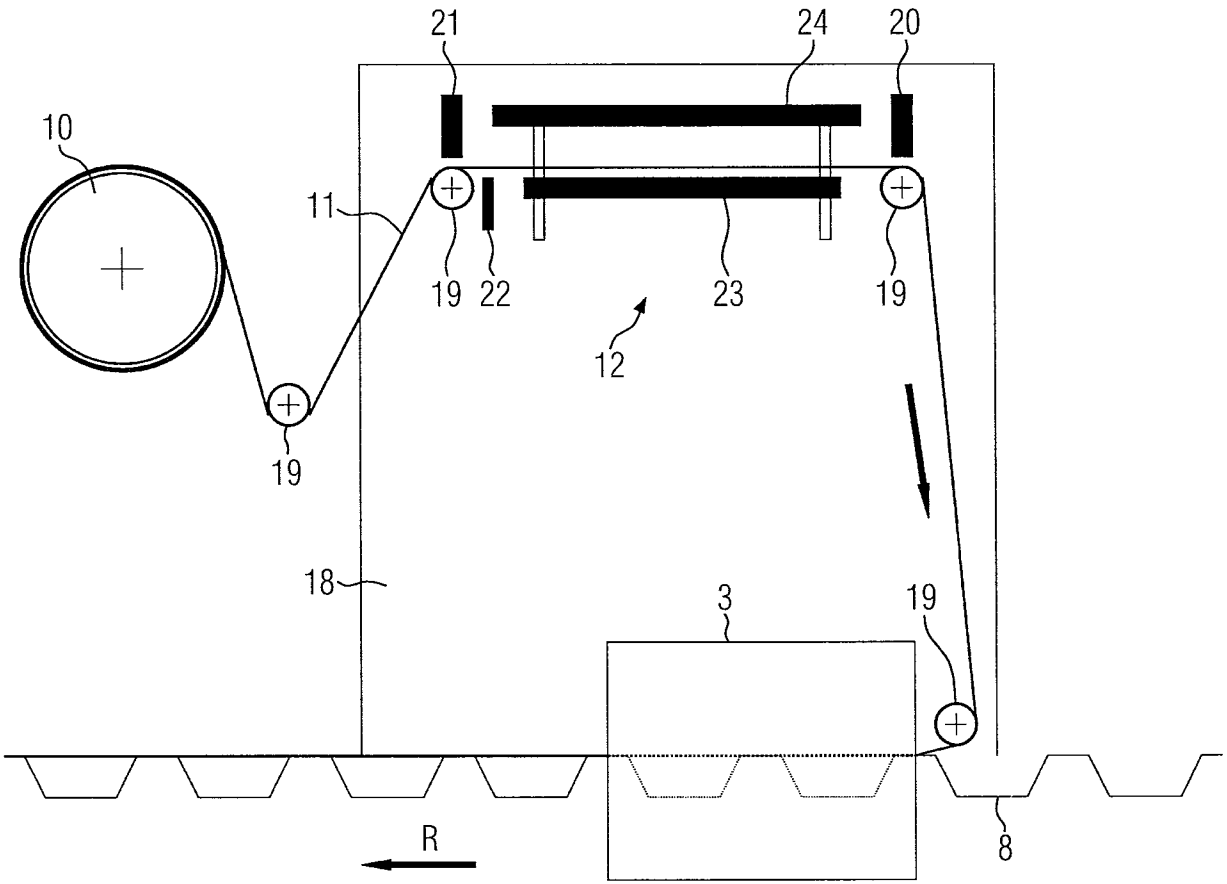
FIG. 2 shows a schematic view of a stretching station during a forward feed of the film.

FIG. 2 shows a stretching station 12 provided on the switch cabinet 18 in the area above the sealing station 3. From the material storage unit 10, the film web 11 is conveyed via deflection pulleys 19 through the stretching means 12 into the sealing station 3. This is accomplished by the forward feed movement of the bottom film 8, which has already sealed thereon a leading area of the film web 11, whereby the film web 11 is entrained. Clamping bars 20 and 21 are shown, as well as a print mark sensor 22, a heating unit 23 and a film cooling device 24. A lifting unit 25 is shown, which is used for moving the heating unit 23 and the film cooling device 24 in common. FIG. 2 shows the moment in time in the process at which the film web 11 is entrained in the transport direction R by the forward feed movement of the bottom film 8. While the film web 11 is being entrained, the print mark sensor 22 detects a print mark provided on the film web 11. The signal of the print mark sensor 22 is transmitted to the controller 17 and the controller 17 ascertains the moment in time at which the clamping bars 20 and 21 close.

Figure 3:
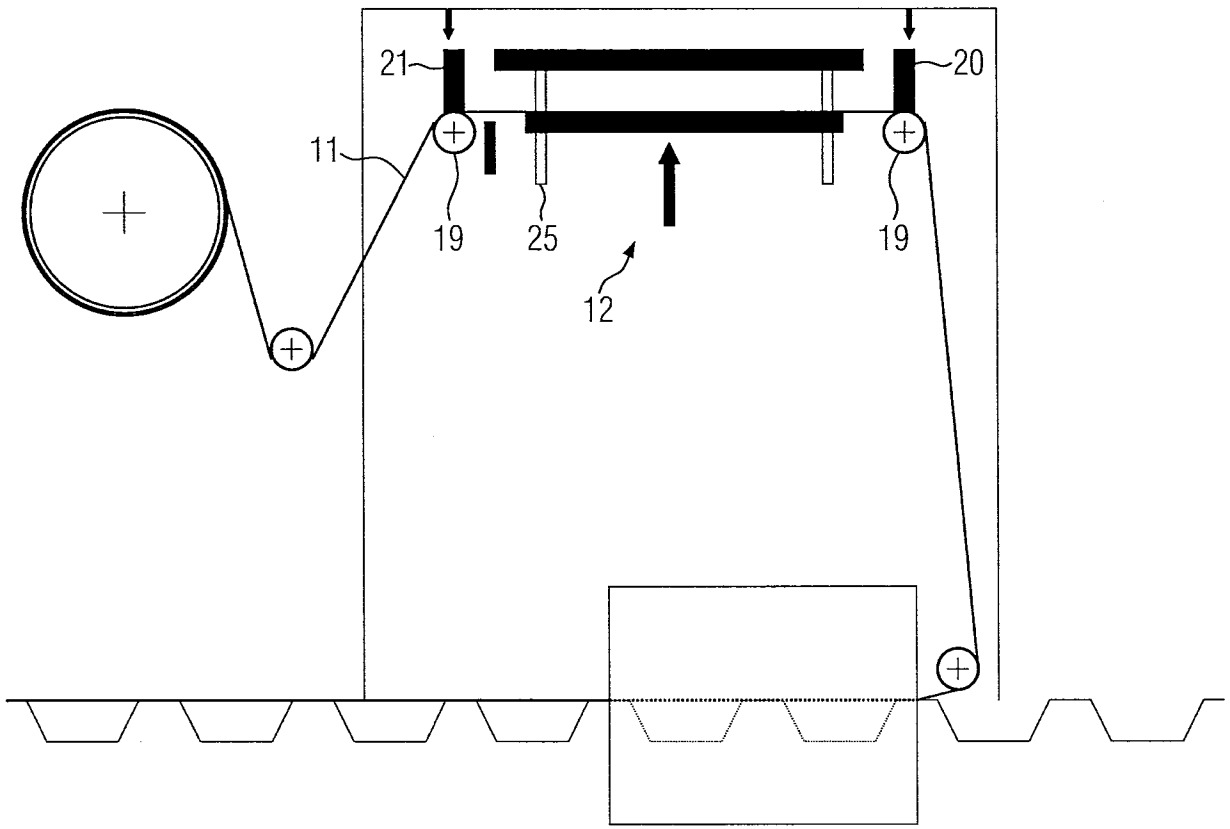
FIG. 3 shows a schematic view of a stretching station with a clamped film web during heating.

While the clamping bars 20 and 21 close, they clamp the film web 11 onto the deflection pulleys 19, as can be seen in FIG. 3. This is preferably done at the end of the intermittent forward feed movement of the bottom film 8. Simultaneously with, prior to or a short time after the clamping of the film web 11, the lifting unit 25 moves the heating unit 23, here shown in the form of a heating plate, onto the film web 11. The heating plate 23 and the film web 11 are now in contact with one another, and the film web 11 is heated to a stretching temperature suitable for the stretching process. The stretching temperature lies close to a glass transition temperature at which a significant change of the mechanical properties, such as hardness and elasticity of the film web 11, will occur. Depending on the composition of the film, this temperature is a temperature between 60° C. and 90° C. In the case of Amorphous Polyethylene Terephthalate (APET), for example, the glass transition temperature is approx. 74° C. Films/foils whose thickness exceeds 200 μm are not ductile at temperatures below 30° C.

Figure 4:
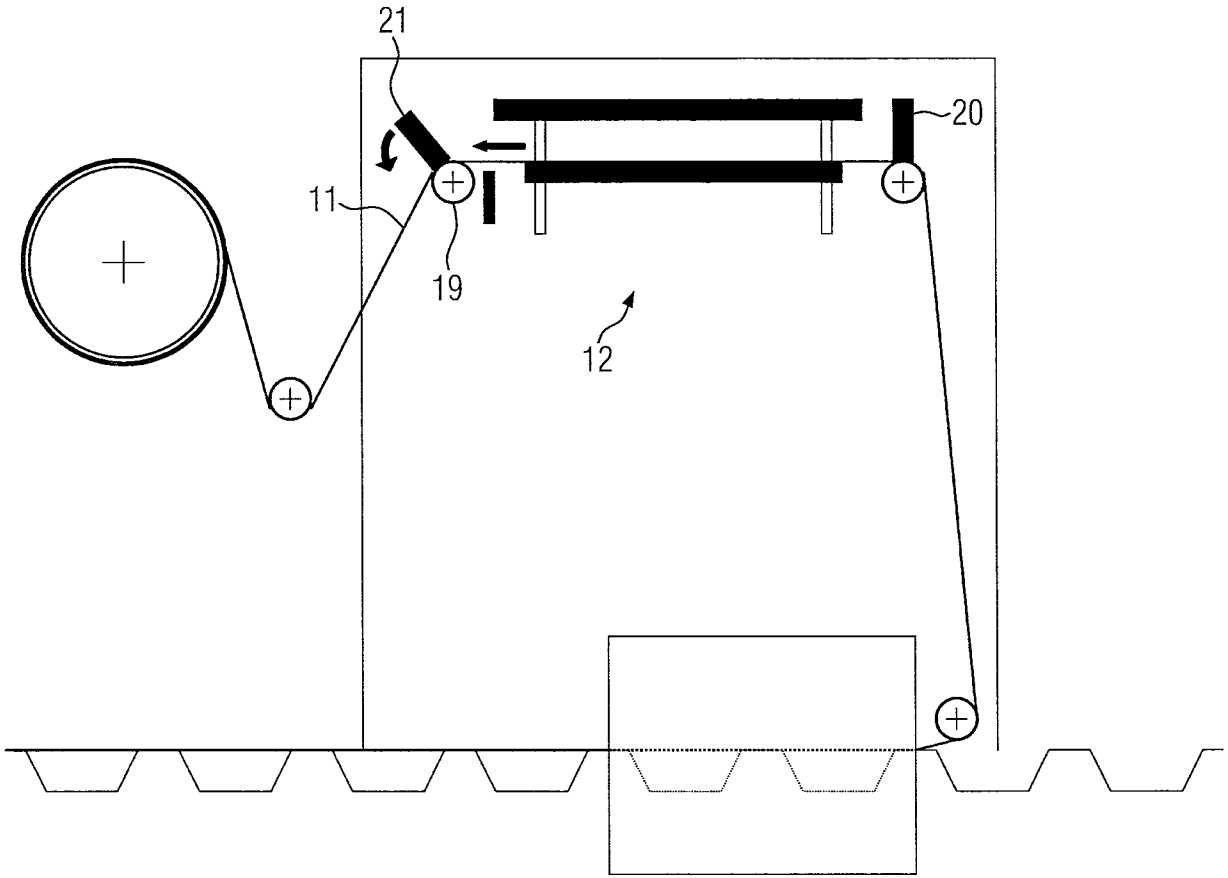
FIG. 4 shows a schematic view of a stretching station during stretching.

During and after the heating phase, stretching of the film web 11 is, as can be seen from FIG. 4, effected by a radial movement of the clamping bar 21 about the deflection pulley 19 in a direction opposite to the feed direction, and the area fixed between the two clamping bars 20 and 21 is stretched. The movement of the clamping bar 21 is caused by a servo drive, which is not shown, said servo drive being controlled by the controller 17 and having the necessary power and adjustment accuracy. Due to the heating of the film web 11, the tensile forces required for stretching are much lower than those required for stretching without a heating unit. The servo drive may keep the film web 11 under tension also after the latter has been stretched, so as to prevent possible creasing.

Figure 5:
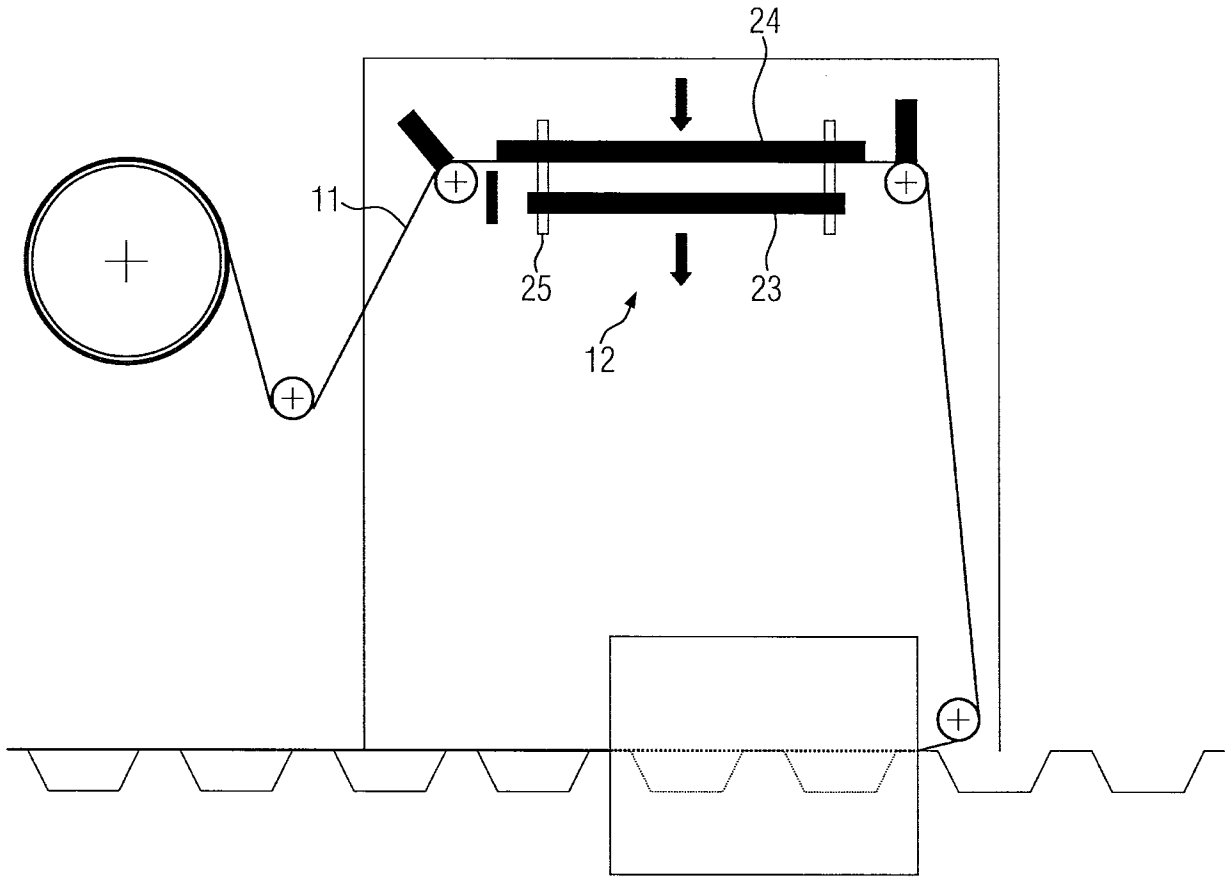
FIG. 5 shows a schematic view of a stretching station during cooling.

FIG. 5 shows the post-stretching phase in which the lifting unit 25 is used for moving the heating unit 23 away from the film web 11 and the film cooling device 24 towards the film web 11, so that they come into contact with one another so as to cool down the temperature of the film web 11 in this area until the film web 11 has been thermofixed in the stretched condition. Preferably, the area of the film cooling device 24 is larger than the film heating unit 23, when seen in the direction of transport, since the film web 11 is heated by the heating unit 23 also in areas beyond said heating unit 23. This will guarantee that the stretched print image of the film web 11 will retain its dimensions until it has been conveyed into the sealing station 3.

The thermofixed length after stretching corresponds to approximately 25% to 30% of the elongation of the clamped film area during the stretching process. This has the effect that also film webs 11 delivered by the film supplier with larger tolerances as regards the length and the position of the print image can be processed making use of a non-varying stretching path of the clamping bar 21. The operator of the thermoform packaging machine can thus reduce the procurement costs.

Figure 6:
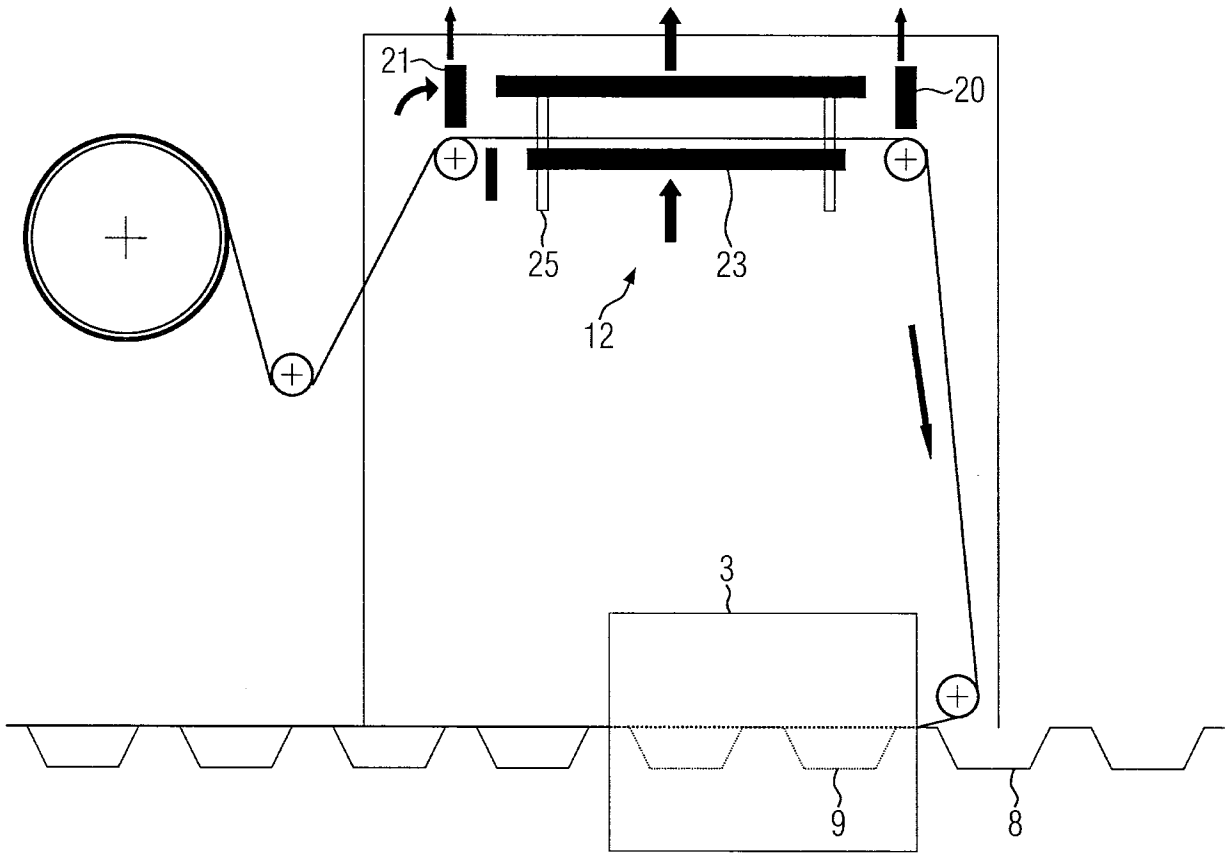
FIG. 6 shows a schematic view of a stretching station prior to a subsequent forward feed movement.

When thermofixing of the film web 11 has been accomplished (cf. FIG. 6), the clamping bars 20 and 21 are opened, the clamping bar 21 is pivoted back to its starting position and the lifting unit 25 moves the film cooling device 24 upwards and away from the film web 11 and the heating unit 23 towards the positions at which the next film portion will be heated. From the moment at which the film web 11 is released by the clamping bars 20, 21, the next forward feed movement and transport of the film web 11 in the direction of the sealing station 3 can be executed.

When the print image has been stretched to the respective length of the packaging trough 9, the film web 11 can be sealed on in a stress-free condition. This, in turn, allows the use of flexible bottom films/foils 8. Likewise, the holes, which are formed in a punching station optionally provided between the stretching station 12 and the sealing station 3, will exactly remain in position, since the film will be elongated neither prior to nor in the sealing station 3. The stretching station 12 will also offer the above-mentioned advantages, when an optional top film forming station and/or a top film clamp chain guide is/are used.

It is also imaginable that the heating unit 23 and the film cooling device 24 have lifting units of their own, so that they can be moved into contact with and away from the film web 11 independently of one another. In order to obtain the best possible heat transfer or cooling, the film can be pulled onto the heating unit 23 and/or the film cooling device 24 by means of a vacuum so as to achieve a uniform contact across the area in question.

A large-area contact between the film web 11 and the heating unit 23 and the film cooling device 24 can also be accomplished by a convex shape at the surface of the heating plate or cooling plate. When the heating unit 23 is moved away, the servo drive may readjust the clamping bar 21 so as to tension the released film web length.

The film cooling device 24 can be cooled permanently by means of water cooling.

Like the clamping bar 21, the clamping bar 20 can be pivotable and it can be configured such that it is pivotable or linearly movable by a servo drive.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A thermoform packaging machine comprising:

a forming station for forming packaging troughs into a first film web; and a stretching station for stretching a second film web, the second film web being a cover film for covering the packaging troughs, the stretching station including a heating unit for heating the second film web, a print mark sensor for sensing a mark on the second film web, a first clamping mechanism upstream of said heating unit for clamping a first location of the second film web, a second clamping mechanism downstream of said heating unit for clamping a second location of the second film web, wherein one of said first clamping mechanism or said second clamping mechanism is moveable to elongate a portion of the second film between said first clamping mechanism and said second clamping mechanism when the second film is clamped by both said first and second clamping mechanisms, and a film cooling device for cooling the second film web; and wherein the stretching station further includes a lifting unit for moving the film cooling device towards and away from the second film web for cooling the second film web after it has been heated and stretched.

2. A thermoform packaging machine according to claim 1 wherein the film cooling device comprises a cooling plate.

3. A thermoform packaging machine according to claim 1 wherein the film cooling device and the heating unit are opposing and located on opposite sides of the second film web when the second film web is received in the stretching station.

4. A thermoform packaging machine according to claim 3 wherein the lifting unit is operably connected to both the film cooling device and the heating unit such that the lifting unit moves the film cooling device and the heating unit together.

5. A thermoform packaging machine according to claim 1 further comprising a sealing station downstream of the stretching station.

6. A thermoform packaging machine according to claim 1 wherein at least one of the first clamping mechanism or the second clamping mechanism is pivotable, wherein when the first and the second clamping mechanism are clamping the second film web, the pivoting of the at least one of the first clamping mechanism or the second clamping mechanism stretches the second film web.

7. A thermoform packaging machine according to claim 6 wherein the at least one of the first clamping mechanism or the second clamping mechanism is moveable by a servo drive.

8. A method of stretching a cover film web in a stretching station of a thermoform machine, the method comprising:

clamping a cover film at a first location upstream of a heating unit with a first clamp;

clamping said cover film at a second location downstream of said heating unit with a second clamp;

heating a portion of the cover film web with said heating unit to a temperature near a glass transition temperature of the film web;

stretching the heated portion of the cover film web by the moving at least one of the first clamp or the second clamp to increase a distance between said first location and said second location when the cover film is clamped by the first clamp and the second clamp;

moving a cooling device toward the cover film web with a lifting device after the heating and stretching steps; and actively cooling the heated and stretched portion of the cover film web with the moved cooling device.

9. A method according to claim 8 wherein the moving a cooling device toward the cover film web step comprises moving a cooling plate.

10. A method according to claim 8 further comprising cooling the cover film web with the cooling device until the cover film web has been thermofixed.

11. A method according to claim 8 further comprising cooling the cover film web through direct contact with the cooling device.

12. A method according to claim 8 further comprising evaluating by a controller a signal received from a print mark sensor, which senses a mark on the cover film web, together with parameters that are stored in the controller and that have been inputted by a user, and controlling the stretching of the cover film web on the basis of the evaluation of the signal received from the print mark sensor.

13. A thermoform packaging machine comprising:

a stretching station configured to receive a film, the stretching station including a heating unit for heating the film, a clamping unit for clamping the film, at least a portion of the clamping unit being moveable to elongate the film, and a film cooling device for actively cooling the film after the film has been heated and stretched, wherein the clamping unit comprises a first clamping bar upstream of the heating unit for clamping the film at a first location and a second clamping bar downstream of the heating unit for clamping the film at a second location, wherein when both the first clamping bar and the second clamping bar are clamping the film, one of the first clamping bar or the second clamping bar is moveable to increase the distance between the first location and the second location to elongate the film.

14. A thermoform packaging machine according to claim 13 wherein the film cooling device and the heating unit are opposing and located on opposite sides of the film when the film is received in the stretching station.

15. A thermoform packaging machine according to claim 13 wherein the stretching station further includes a lifting unit for moving the film cooling device toward and away from the film.

16. A thermoform packaging machine according to claim 15 wherein the lifting unit is operably connected to both the film cooling device and the heating unit for moving the film cooling device and the heating unit together relative to the film.

17. A thermoform packaging machine according to claim 13 wherein said one of the first clamping bar or the second clamping bar is pivotable.

18. A thermoform packaging machine according to claim 13 wherein the entire stretching station is disposed upstream of a sealing station.

* * * * *